US008452037B2

(12) United States Patent
Filson et al.

(10) Patent No.: US 8,452,037 B2
(45) Date of Patent: May 28, 2013

(54) SPEAKER CLIP

(75) Inventors: John Benjamin Filson, Mountain View, CA (US); Eugene Whang, San Francisco, CA (US); Matthew Rohrbach, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 435 days.

(21) Appl. No.: 12/774,395

(22) Filed: May 5, 2010

(65) Prior Publication Data

US 2011/0274303 A1 Nov. 10, 2011

(51) Int. Cl.
*H04R 25/00* (2006.01)

(52) U.S. Cl.
USPC ..... 381/334; 381/306; 381/332

(58) Field of Classification Search
USPC ..... 381/306, 311, 333–334, 388
See application file for complete search history.

(56) References Cited

U.S. PATENT DOCUMENTS

| | | | |
|---|---|---|---|
| 4,081,631 | A | 3/1978 | Feder |
| 4,658,425 | A | 4/1987 | Julstrom |
| 5,335,011 | A | 8/1994 | Addeo et al. |
| 5,570,324 | A | 10/1996 | Geil |
| 5,619,583 | A | 4/1997 | Page et al. |
| 6,073,033 | A | 6/2000 | Campo |
| 6,129,582 | A | 10/2000 | Wilhite et al. |
| 6,151,401 | A | 11/2000 | Annaratone |
| 6,154,551 | A | 11/2000 | Frenkel |
| 6,192,253 | B1 | 2/2001 | Charlier et al. |
| 6,317,237 | B1 | 11/2001 | Nakao et al. |
| 6,813,218 | B1 | 11/2004 | Antonelli et al. |
| 6,829,018 | B2 | 12/2004 | Lin et al. |
| 6,882,335 | B2 | 4/2005 | Saarinen |
| 6,934,394 | B1 | 8/2005 | Anderson |
| 7,003,099 | B1 | 2/2006 | Zhang et al. |
| 7,082,322 | B2 | 7/2006 | Harano |
| 7,154,526 | B2 | 12/2006 | Foote et al. |
| 7,158,647 | B2 | 1/2007 | Azima et al. |
| 7,263,373 | B2 | 8/2007 | Mattisson |
| 7,266,189 | B1 | 9/2007 | Day |
| 7,378,963 | B1 | 5/2008 | Begault et al. |
| 7,536,029 | B2 | 5/2009 | Choi et al. |
| 8,116,506 | B2 * | 2/2012 | Kuroda et al. ..... 381/388 |
| 2004/0203520 | A1 | 10/2004 | Schirtzinger et al. |
| 2005/0271216 | A1 | 12/2005 | Lashkari |

(Continued)

FOREIGN PATENT DOCUMENTS

| | | |
|---|---|---|
| EP | 2094032 | 8/2009 |
| GB | 2310559 | 8/1997 |

(Continued)

OTHER PUBLICATIONS

Baechtle et al., "Adjustable Audio Indicator," IBM, 2 pages, Jul. 1, 1984.

Pingali et al., "Audio-Visual Tracking for Natural Interactivity," Bell Laboratories, Lucent Technologies, pp. 373-382, Oct. 1999.

*Primary Examiner* — Suhan Ni
(74) *Attorney, Agent, or Firm* — Dorsey & Whitney LLP

(57) ABSTRACT

Certain embodiments may take the form of an electronic device having a main housing encapsulating operative circuitry for the device. The electronic device includes an attachment member moveably coupled to the metal housing. The attachment member has an acoustical device located therein that is communicatively coupled to the operative circuitry in the main housing. The attachment member includes a recessed portion for positioning the acoustical device within the attachment member.

13 Claims, 8 Drawing Sheets

U.S. PATENT DOCUMENTS

| | | | |
|---|---|---|---|
| 2006/0072248 | A1 | 4/2006 | Watanabe et al. |
| 2008/0204379 | A1 | 8/2008 | Perez-Noguera |
| 2008/0292112 | A1 | 11/2008 | Valenzuela et al. |
| 2009/0247237 | A1 | 10/2009 | Mittleman et al. |
| 2009/0274315 | A1 | 11/2009 | Carnes et al. |
| 2009/0316943 | A1 | 12/2009 | Munoz et al. |
| 2010/0103776 | A1 | 4/2010 | Chan |
| 2011/0002487 | A1 | 1/2011 | Panther et al. |
| 2011/0033064 | A1 | 2/2011 | Johnson et al. |
| 2011/0161074 | A1 | 6/2011 | Pance et al. |
| 2012/0082317 | A1 | 4/2012 | Pance et al. |
| 2012/0250928 | A1 | 10/2012 | Pance et al. |
| 2012/0263019 | A1 | 10/2012 | Armstong-Muntner |

FOREIGN PATENT DOCUMENTS

| | | | |
|---|---|---|---|
| GB | 2342802 | | 4/2000 |
| JP | 2-102905 | | 4/1990 |
| JP | 2102905 | | 4/1990 |
| WO | WO03/049494 | | 6/2003 |
| WO | WO2004/025938 | | 3/2004 |
| WO | WO 2004/025938 | A1 | 3/2004 |
| WO | WO2007/083894 | | 7/2007 |
| WO | WO2008/153639 | | 12/2008 |
| WO | WO2009/017280 | | 2/2009 |
| WO | WO2011/057346 | | 5/2011 |

* cited by examiner

SPEAKER CLIP

BACKGROUND

1. Technical Field

The present invention relates to electronic devices providing auditory output and, more particularly, to an electronic device providing auditory output from an attachment member of an electronic device.

2. Background Discussion

Small form factor electronic devices such as personal digital assistants, cell phones, mobile media devices and so on have become nearly ubiquitous in today's society. Among other functions, they may serve as work tools, communication devices and/or provide entertainment and are commonly carried in a hand, with a clip or in a pocket. Generally, the operative parts of electronic devices, such as the processor and memory, are enclosed in housings made of plastic, metal and/or glass that may have an aesthetically pleasing appearance. The housings provide structural integrity to the devices and protect potentially sensitive component parts of the electronic devices from external influences. Sometimes, a smaller form factor device will be more popular or able to demand a higher retail price than a functionally equivalent larger device.

SUMMARY

Certain aspects of embodiments disclosed herein are summarized below. It should be understood that these aspects are presented to provide the reader with a brief summary of certain forms embodiments might take and that these aspects are not intended to limit the scope of any embodiment. Indeed, any embodiment disclosed and/or claimed herein may encompass a variety of aspects that may not be set forth below.

Certain embodiments may take the form of an electronic device that includes a main housing encapsulating operative circuitry for the device. An attachment member is movably coupled to the main housing. The attachment member may be movably coupled to the main housing in one of a number of different ways, such as a spring loaded hinge, for example. An acoustical device is positioned within a portion of the attachment member. The acoustical device is communicatively coupled to the operative circuitry in the main housing.

Another embodiment may take the form of an electronic device having a main housing for holding a processor of the electronic device and an attachment clip moveably coupled to the main housing. The attachment clip includes a cavity and an acoustical device located within the cavity of the attachment clip. The acoustical device is communicatively coupled to the processor via a conduit.

In yet another embodiment, a method of manufacturing a small form factor electronic device may be provided. The method includes milling a main housing and an attachment member. A recessed region is created within the attachment member and an acoustical device is positioned within the recessed region of the attachment member. An adhesive layer may be applied to secure the acoustical device to the clip on one or more sides. A cover layer may be attached to the acoustic device with an adhesive layer. In some embodiments, the cover may be attached to the clip. The adhesive is applied so as to not block sound from exiting. The main housing and attachment member are coupled together.

DETAILED DESCRIPTION

Figure 1:
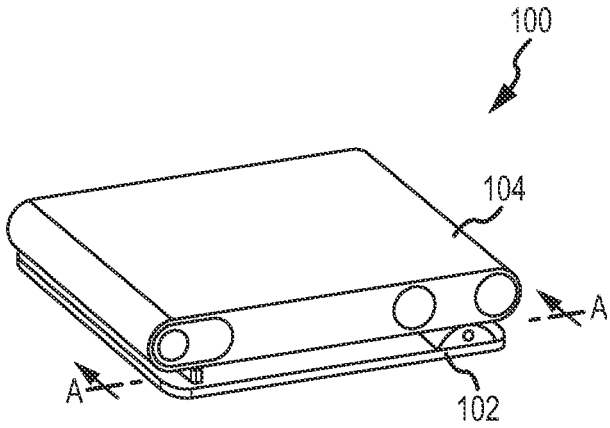
FIG. 1 illustrates a small form factor electronic device having an acoustical device located in an attachment member.

Certain embodiments may take the form of an electronic device having an acoustical element located outside a main housing of the device. For example, the acoustical element may be positioned in an attachment clip of the electronic device to provide acoustic functionality without taking up space within the main housing of the device.

In some embodiments, the acoustical element may be positioned within an attachment member moveably coupled to a main housing. The acoustical member may take the form of a piezoelectric acoustical element. Generally, piezoelectric acoustical elements are thin, flat elements that vibrate when an electrical current is applied to generate sound. More specifically, piezoelectric acoustical elements include a material, such as some quartz crystals, that demonstrates a piezoelectric effect and flexes or deflects when an electrical current is applied to the material. The movement of the material is transferred to a diaphragm of the element which correspondingly moves or vibrates to generate sound. To allow for vibration of the diaphragm, the piezoelectric element may be set off by a clearance distance from a surface of the attachment member into which it is installed. In some embodiments, multiple layers may be positioned on top of the piezoelectric element to protect and secure the piezoelectric element, among other functions. In some embodiments, the piezoelectric element may be mounted in between two surfaces to create sandwich-like structure.

In some embodiments the mounted piezoelectric element (and the various other layers, if included) do not substantially change the appearance of the attachment member in which the element is installed. That is, if the surface of the attachment member is flat, the installation of the piezoelectric element results in a substantially flat surface. In other embodiments, the surface of may be changed to provide an increased cavity size. In some embodiments, the cavity size may be shaped to create a particular frequency response or to otherwise influence the sound produced by the acoustical element. In some embodiments, the interior surface of the cavity may be modified to increase the size of the cavity, to control the frequency response of the cavity, modify the amount of air displaceable by movement of the diaphragm of the acoustical element, and/or to direct sound waves within the cavity and/or out of the cavity. The shape of the surface may be configured to resonate at a certain desired frequency or frequency range that is desired based on its shape. For example, one or more indentations in the surface may be provided to increase the size of the cavity and/or control the frequency response of the cavity. Generally, the larger the size of the cavity, the lower the frequency that may be resonant within the cavity. In some embodiments, holes may be provided in the surface to adjust the frequency response. Additionally, the cavity may be modified to aid in the assembly of the acoustic device such as alignment or attachment, or to change the stiffness of the walls of the cavity, such as adding ribs to increase stiffness without substantially reducing cavity volume, or to provide room for a conduit to pass therethrough.

Figure 2:
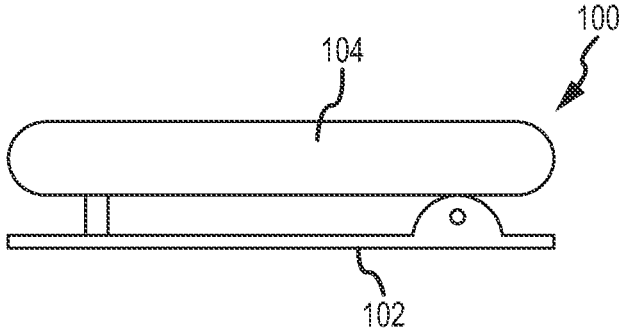
FIG. 2 illustrates a side-view of the electronic device of FIG. 1.

Turning to FIGS. 1 and 2, an example electronic device 100 with an attachment member 102 is illustrated. The attachment member 102 is moveably coupled to a main housing 104 of the electronic device 100. Generally, the main housing 104 houses the operative circuitry of the electronic device 100, such as a processor, memory, and so forth. The electronic device 100 may be configured to function as a media recorder/playback device such as an MP3 player, a radio, an audio/video recorder, a mobile telephone, personal digital assistant, tablet computing device, or other similar device. In certain embodiments, the electronic device 100 may have an all metal, or primarily metal, exterior or layer. In other embodiments, a portion (such as a back, front or other side) of the housing 104 may be made from metal or primarily from metal. The housing 104 may be made, in part or in whole, of aluminum, magnesium, titanium, an aluminum alloy, a magnesium alloy, a titanium alloy, steel, or other metal or metal alloy. In some embodiments, the housing 104 and attachment member 102 may be made partially or fully of plastic, glass and/or a composite such as a ceramic. It should be appreciated that the material used for the attachment member 102 may influence the frequency response of the acoustical element. As such, in some embodiments, the attachment member 102 or a portion of the attachment member 102 (such as a portion in which a cavity is formed) may be of a different material than the housing 104.

One or more apertures in the metal body may be configured to allow for input/output functionality to be accessed and/or for power or charging. For example, an aperture may be provided with one or more buttons to turn on/off the device 100 and/or control the operations of the device 100. Additionally, an aperture may be provide to allow for headphones to connect to with the electronic device 100. In other embodiments, however, no such apertures are provided and the input/output may be conducted wirelessly.

The electronic device 100 may have a small form factor such that it is easily carried in a hand or pocket. These sample embodiments may range from approximately 2"×4" to about 1" square, although alternative embodiments may be larger or smaller. Typically, the attachment member 102 is movably coupled to the electronic device 100 to allow the electronic device 100 to be attached in a convenient location for a user, such as clipped on an article of clothing. In another embodiment, the attachment member may be a band, such as a watchband for example. Additionally, in some embodiments, the attachment member 102 may be made of the same metal or other material as the housing 104 of the electronic device 100.

Figure 3:
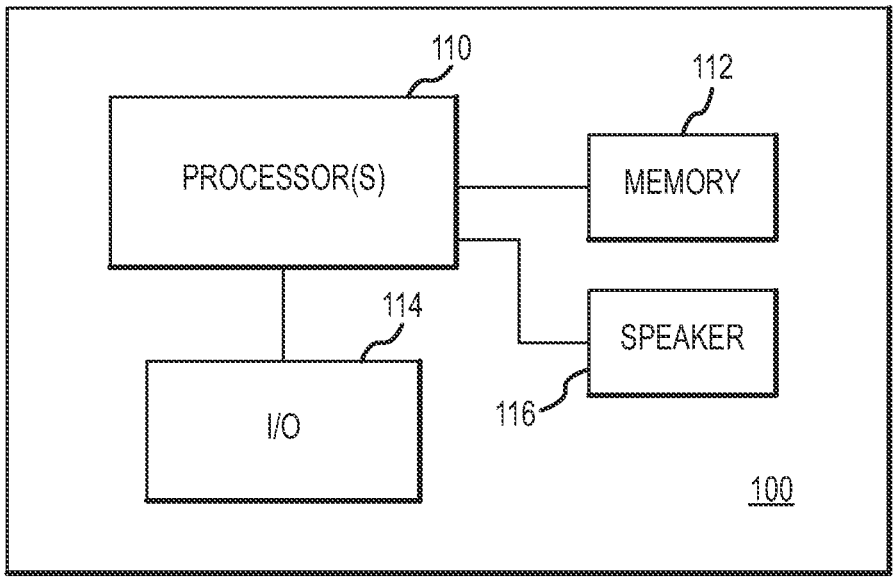
FIG. 3 is a block diagram of the electronic device of FIG. 1.

FIG. 3 is an example block diagram of the electronic device 100. The electronic device 100 includes one or more processors 110, a memory 112, and one or more I/O devices 114. The one or more processors 110 may include one or more general processors, such as a central processing unit and/or one or more dedicated processors, such as a graphics processing unit. The memory 112 is coupled to the one or more processors 110 and may be implemented as one or more memory types such as magnetic memory (including but not limited to read only memory, flash memory, random access memory,) At least one I/O device may take the form of an acoustical element 116, such as a speaker. One example of a suitable acoustical element 116 or other audio output device is the aforementioned piezoelectric element. This element may be positioned in an appropriately shaped space to act as a speaker as described below in greater detail with respect to FIG. 4. The electronic device 100 may also provide one or more other output modes, such as a visual output (e.g., one or more light emitting diodes, a graphic display, and so on), a haptic output, and so forth.

The acoustical element 116 may be positioned within the attachment member 102 of the electronic device (e.g., outside the main housing 104 of the device 100). The placement of the acoustical element 116 within the attachment member allows the element to provide audible output without taking up space within the main housing 104. Furthermore, the placement of the acoustical device within the attachment member 102 may facilitate customization of the acoustical properties of surfaces that surround and/or house the acoustical device to help improve the quality of sound generated by the electronic device 100.

Figure 4:
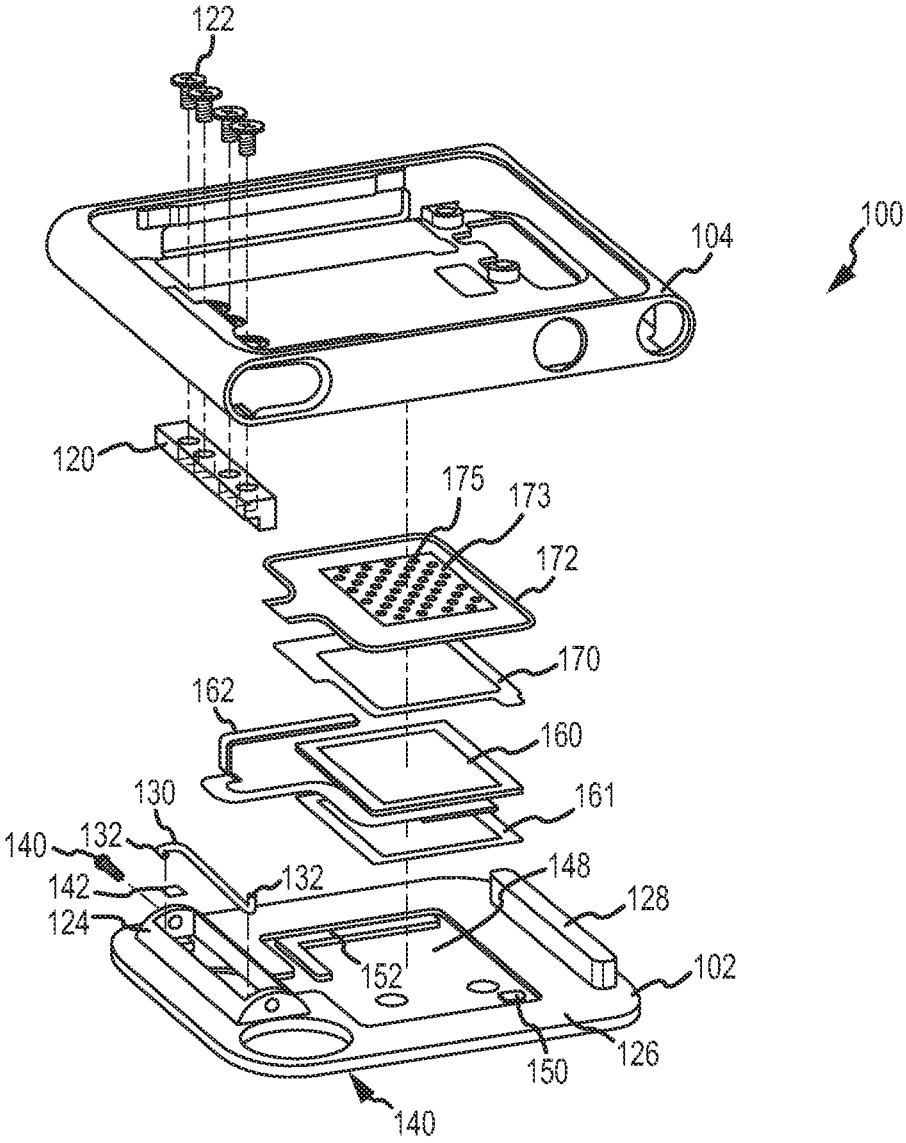
FIG. 4 is an exploded view of the attachment member and a main housing of the electronic device of FIG. 1.

Turning to FIG. 4, an exploded view of the electronic device 100 is illustrated. In the exploded view, electrical components of the main housing 104 have been omitted to simplify the illustration and to focus attention on the acoustical element 116 positioned within the attachment member 102. However, it should be appreciated that the main housing 104 generally holds one or more electrical components that may be in electrical and/or operable communication with the acoustical device 116.

As shown in FIG. 4, the attachment member 102 is moveably coupled to the main housing 104 by a hinge block 120. The hinge block 120 may be fastened to the main housing 104 with one or more fastening devices 122 (e.g., screws, pins and the like). The hinge block 120 generally sits within a recess defined in the attachment member 102 and adjacent to a base of the main housing. In some embodiments, the hinge block 120 may at least partially define a distance that a surface 126 of the attachment member 102 is held from the main housing 104. In other embodiments the distance between the surface 126 and the main housing 104 may be greater than a height of the hinge block 120. One or more other members 128 located at an opposite end of the attachment member 102 from the hinge block 120 may also be provided to assist in defining the distance of the attachment member 102 from the main housing 104. The other member 128 may protrude from the surface 126 and may be configured to abut or make contact with the main housing 104.

A spring member 130 may be positioned within or adjacent to the hinge block 120 to bias the attachment member 102 to a closed position. In one embodiment, the spring member 130 may be an elongated rod with bent ends 132. Each end 132 is configured to touch one of a surface of the attachment member 102 and the hinge block 120 which is rigidly fastened to the main housing 104 with fastening devices 122. As the attachment member 102 is opened by applying a force to attachment member or main housing, the spring member 130 may be displaced from its resting position thereby providing resistance to the opening motion. The opening force must overcome the biasing force of the spring member to open the attachment member 102. Additionally, the biasing force of the spring member 130 returns the attachment member 102 to a closed position when the countervailing opening force stops. Other types of springs and other configurations may be implemented to achieve the same or similar functionality.

In some embodiments, one or more hinge pins 140 may inserted through a portion of the attachment member 124 and into the hinge block 120 to moveably secure the attachment member 102 and the main housing together 104. A longitudinal axis of the hinge pins 140 may be oriented to face each other within a common line. The hinge pins 140 may function as an axis of rotation for movement of the attachment member 102. The longitudinal axis of the pins may generally be parallel with the surfaces of the attachment member 102 and the main housing 104. In some embodiments, the one or more hinge pins may also function as spring members to hold the attachment member 102 in a closed position relative to the main housing. To do so, at least one end of the hinge pins 140 may be modified to provide a torsion resistance against one of the main housing or attachment member and the hinge block. Additionally, in some embodiments, the hinge pins 140 are secured or anchored within the hinge block to prevent the hinge pins rotating freely relative to the hinge block. It should be appreciated that other devices and/or techniques may be implemented in other embodiments to moveably secure the main housing and the attachment member together. For example, in some embodiments, a coil spring may be provided to bias the attachment member. The coil spring may be oriented along an axis of rotation or perpendicular thereto.

Spring plates 142 may be provided on the surface of one or both the attachment member 102 and hinge block 120 where the spring contacts the surface(s) to reduce deflection of and prevent galling of the surfaces. The spring plates 142 may be small patches of hard material, such as stainless steel, tungsten, or ceramic, for example, that help to reinforce and/or strengthen the surfaces against the pressures that the spring member places upon the surfaces. In embodiments where the thickness of the attachment member 102 and the walls of the main housing 104 are particularly thin, the spring plates 142 help to maintain the original shape and appearance of the attachment member and main housing.

As shown in FIG. 4, the attachment member 102 may be milled to remove material in order to create a recessed region 148. The recessed region 148 may generally have a size and shape that is at least the size and shape of an acoustical member that is to be installed within the attachment member. The recessed region 148 may also have a size and shape designed to affect the sound outputted by the acoustical device. For example, the size of the recessed region 148 may influence a frequency response of the recessed region. Additionally, indentations holes or other features may be provided within the recessed region to direct reflections of sound waves, or increase the movement of air within the recessed region or the amount of air moved within the recessed region, for example. Within the recessed region 148, there may be one or more guide/support structures 150, 152. The guide/support structures 150, 152 may be configured to help orient the acoustical device within the aperture when assembling the electronic device 100. Additionally, guide/support structures 150, 152 help to align the acoustical element and provide a bonding area to attach a cover to the attachment member 102 with an adhesive. In some embodiments, guide/support structures 150, 152 is integral to the attachment member 102, through it could also be a separate part in other embodiments.

The acoustical device may be any suitable acoustical device. In one embodiment, the acoustical member is a piezoelectric speaker, as illustrated in FIG. 4. The illustrated piezoelectric speaker 160 includes an electrical conduit 162 that may couple the speaker with components in the main housing 104. The electrical conduit 162 may be any suitable electrically conductive member such as a coaxial cable, flex microstrip (as shown), fine gage wire, or the like. The electrical conduit 162 may flex and bend to move with the attachment member 104 and may pass through or along side the hinge block 120 and into the main housing 104 of the electronic device 100.

It should be appreciated that selection of a particular electrical conduit 162 for communication between components in the main housing 104 and the acoustical device 160 in the attachment member 102 may result in certain trade-offs. For example, electrical communication between the acoustical device and components located in the main housing may be achieved through fine gage wires or other suitable current carrying members. For example, the flex microstrip may be made flexible along at least one axis and may be thinner than a wire. This, in turn, may permit a shallower recessed region in the attachment member 102. In contrast, a small hole may be used to accommodate fine gage wire in both the attachment member 102 and the main housing 104, thus potentially simplifying and/or limiting the amount of machining required.

Glue or grease may be used to seal any openings in the attachment member 102 and/or the main housing 104 resulting from the electrical conduit 162 passing between the two. The glue or grease may be applied during the assembly process.

The piezoelectric speaker 160 may be coupled to the attachment member 102 with an adhesive layer 161. In some embodiments, the adhesive layer 161 may be integral with the underside of the piezoelectric speaker 160 (i.e., pre-assembled with the speaker), while in other embodiments, the adhesive layer may be a separate layer, as illustrated. Additionally, in some embodiments, the adhesive layer 161 may be configured as individual strips of adhesive that may be located along one or more sides of the piezoelectric speaker 160.

One or more additional layers may be provided over the piezoelectric speaker 160 to secure the speaker in place, protect the speaker, and/or to provide aesthetics. In particular, an adhesive layer 170 and a cover layer 172 may be stacked over the piezoelectric speaker 160. The adhesive may be located between the piezoelectric speaker 160 and the cover layer 172 to secure the cover layer to the speaker. Additionally, the adhesive layer 170 may be configured to adhere to the structures 150 and 152.

The cover layer 172 provides rigid support and protection for the piezoelectric element 160 while allowing sound to pass therethrough. In some embodiments, the cover layer 172 may have a solid surface to seal the cavity from the environment. In other embodiments, the cover layer 172 may include a plurality of perforations so as to not block sound. Additionally, in the embodiment illustrated in FIG. 4, the cover layer 172 may be configured to hold a mesh layer 173 having perforations 175 to allow for sound to pass therethrough. The mesh layer 173 generally is thinner than the cover layer 172 and may have smaller perforations than those in the cover. The smaller holes still allow for sound to pass through but limit dust and moisture intrusion. The mesh layer 173 may be made from materials different from those of the cover 172. For example, the mesh layer may include materials such as fabric woven from plastic, metal, or natural fibers. An adhesive layer may be provided to adhere the mesh layer 173 to the cover layer 172.

In some embodiments, the presence and/or position of the piezoelectric speaker 102 may be difficult for a user to visually perceive. For example, an outer layer above the piezoelectric speaker 160 may be substantially flush with the surface 126 of the attachment clip 102 and may have a substantially similar color and texture.

Figure 5:
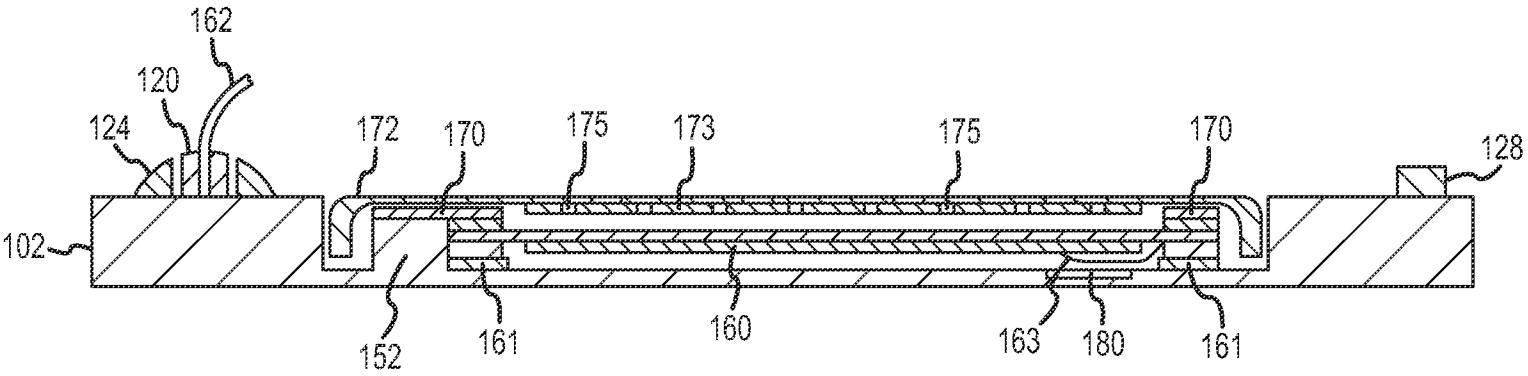
FIG. 5 illustrates a cross-sectional view of the electrical device of FIG. 1 taken along line AA in FIG. 1.

FIG. 5 illustrates a cross-sectional view of the attachment clip 102 along line AA in FIG. 1. The total thickness of the attachment clip 102 may be approximately 1.33 mm thick or less (e.g., approximately 1.15 mm thick). An outer wall of the attachment clip may be less than 0.5 mm at its thinnest point (e.g., approximately 0.35 mm where the piezoelectric speaker is positioned). A thin layer 180 of material may coat an interior surface of the attachment member. In some embodiments, the thin layer 180 is an electrical insulator to insulate the raised, conductive attachment point 163 (i.e., solder joint between the conduit 162 and the piezoelectric speaker 160) from making contact with the material 102, which in some embodiments is electrically conductive. In some embodiments, the thin layer 180 may be an approximately 0.05 mm Kapton® film layer that is only in a few small spots such as under the electrical attachment point. Additionally, the thin layer 180 may be positioned within a recess of the recessed portion 148 of the attachment member 102.

The piezoelectric speaker 160 may include packaging that provides clearance between the diaphragm of the speaker and the attachment member 102. Additionally, the adhesive 161 that attached the speaker 160 to the attachment member 102 may provide clearance. For example, in some embodiments, the adhesive 161 may provide approximately 0.05 mm clearance between a diaphragm of the speaker 160 and the attachment member 102. Additionally or alternatively, in some embodiments, the thin layer 180 may abut the packaging of the speaker 160 while providing an opening adjacent to the diaphragm of the speaker to increase the clearance. Additionally, in some embodiments, guides may be provided in the recessed portion of the attachment member 102 which may support the packaging of the speaker 160 to provide the clearance. Generally, increasing the offset of the diaphragm of the speaker relative to other surfaces allows for more air to be displaced and may provide for improved acoustic quality and/or increased volume. In some embodiments, the piezoelectric speaker 160 may be located approximately 0.04-0.06 mm above the thin film 180. A pressure sensitive adhesive (such as the adhesive layer 170) may be positioned over the piezoelectric speaker 160 to secure the speaker. The adhesive 170 may be approximately 0.04-0.06 mm thick. The cover layer 172 (including the mesh layer 173) may be secured to the adhesive 170. The cover layer 172 may be approximately 0.15 mm thick.

Figure 6:
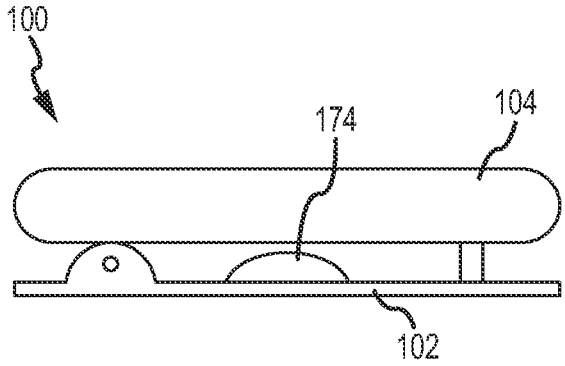
FIG. 6 illustrates an attachment member of the electronic device of FIG. 1 with a domed cover layer.

In some embodiments, the cover plate 172 may have a particular shape to provide specific acoustical effects. For example, the cover plate 172 may have a domed feature 174, as illustrated in FIG. 6, or other geometric shape. The domed feature 174 may be used to increase the volume of air that may be displaced by the diaphragm of the speaker and/or may also provide for improved frequency response at lower frequencies. Other geometric shaped may be used to direct the sound output from the speaker and/or amplify the sound. For example, the cover may have a horn or fan shape that would help to amplify the volume of the sound.

Figure 7:
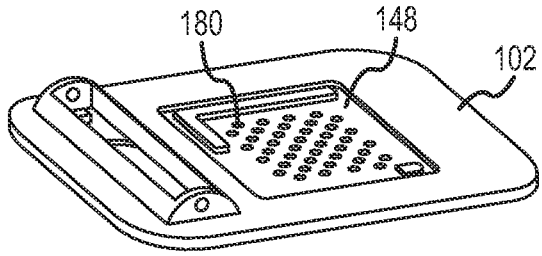
FIG. 7 illustrates a dimpled surface of an attachment member of the electronic device of FIG. 1.

In some embodiments, an interior surface of the recessed portion 148 of the attachment member 102 and/or the interior surface of the cover layer 172 may be dimpled, as shown in FIG. 7. The dimpling may be configured to provide increased air space without sacrificing the structural integrity of the surfaces. As such, the dimples may have a depth, diameter and spacing that preserves the strength of the surfaces. In some embodiments, the dimples may be arranged randomly while in other embodiments, the dimples may be arranged in a grid pattern or other pattern that may be determined to provide an improved sound quality.

Figure 8:
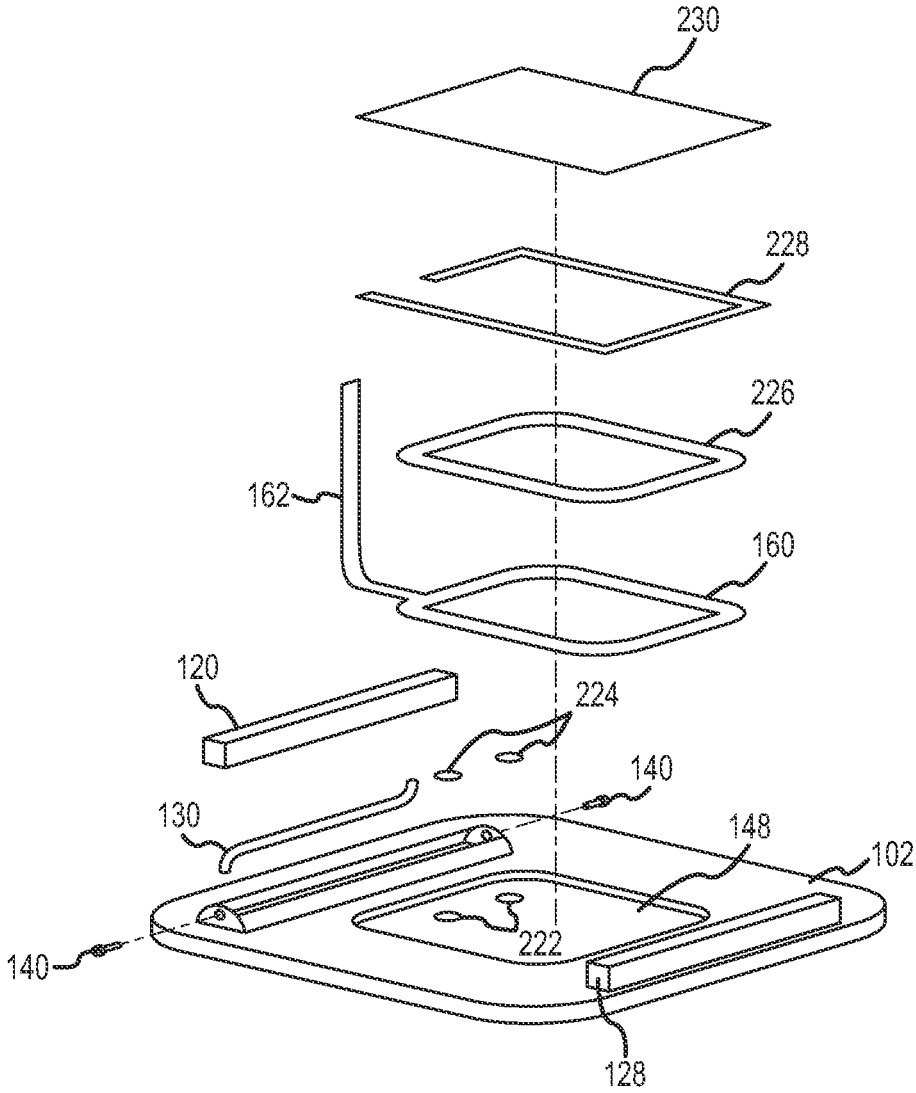
FIG. 8 is an exploded view of the attachment member of the electronic device of FIG. 1 in accordance with an alternative embodiment.

FIG. 8 illustrates an exploded view of the attachment member 102 in accordance with an alternative embodiment. As with the embodiment discussed above, the attachment member 102 includes a recessed region 148 for positioning of an acoustical element therein, a hinge block 120, a spring member 130, hinge pins 140, and so forth. In FIG. 6, items that correspond with previously discussed items maintain the same numbering. The recessed region 148 may include further recessed portions 222 for accommodating pieces of dielectric material 224, such as Kapton® film. The dielectric material 224 is generally located in a position that corresponds with a conductive attachment point for the acoustical element 160, to prevent electrical communication between the attachment member 102 and the acoustical element.

A first adhesive layer 226 may be provided over the acoustical element 160 to secure the acoustical element to the attachment member 102. A second adhesive layer 228 and a cover layer 230 are also provided. The second adhesive layer 228 secures the cover layer 230 to the attachment member 102. Each of the adhesive layers 226, 228 are configured so as to allow sound to pass through (i.e., without a center area, or with perforations in a center area). Additionally, as discussed above, the cover layer 230 may be configured to limit the amount of sound that is blocked while providing structure and protection. That is, the cover layer 230 is configured to allow sound to pass through.

Figure 9:
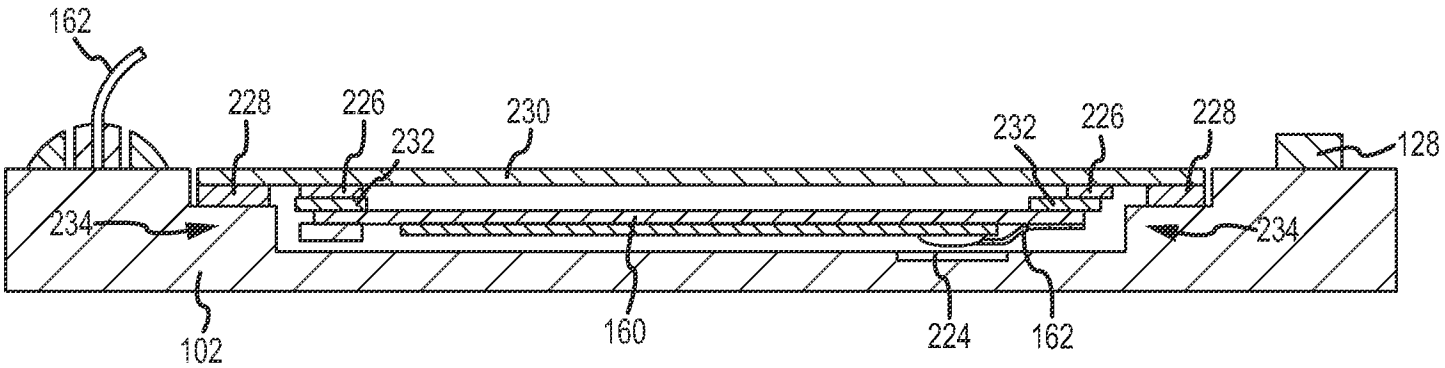
FIG. 9 illustrates a cross-sectional view of the attachment member of FIG. 8 along taken along line AA.

FIG. 9 illustrates a cross-sectional view of the attachment member of FIG. 8. As shown, the dielectric material 224 is located underneath an conductive attachment point (e.g., a solder joint) that couples the piezoelectric speaker 160 with the conduit 162. The first adhesive layer 226 is coupled to the packaging 232 of the piezoelectric speaker 160 and the cover 230, such that the speaker is suspended within the cavity. The second adhesive layer 228 secures the cover 230 to the attachment member 102. In particular, structures 234 may be provided within the recess 148 to allow for flush or nearly flush mounting of the cover 230 with the surface of the attachment member 102.

Figure 10:
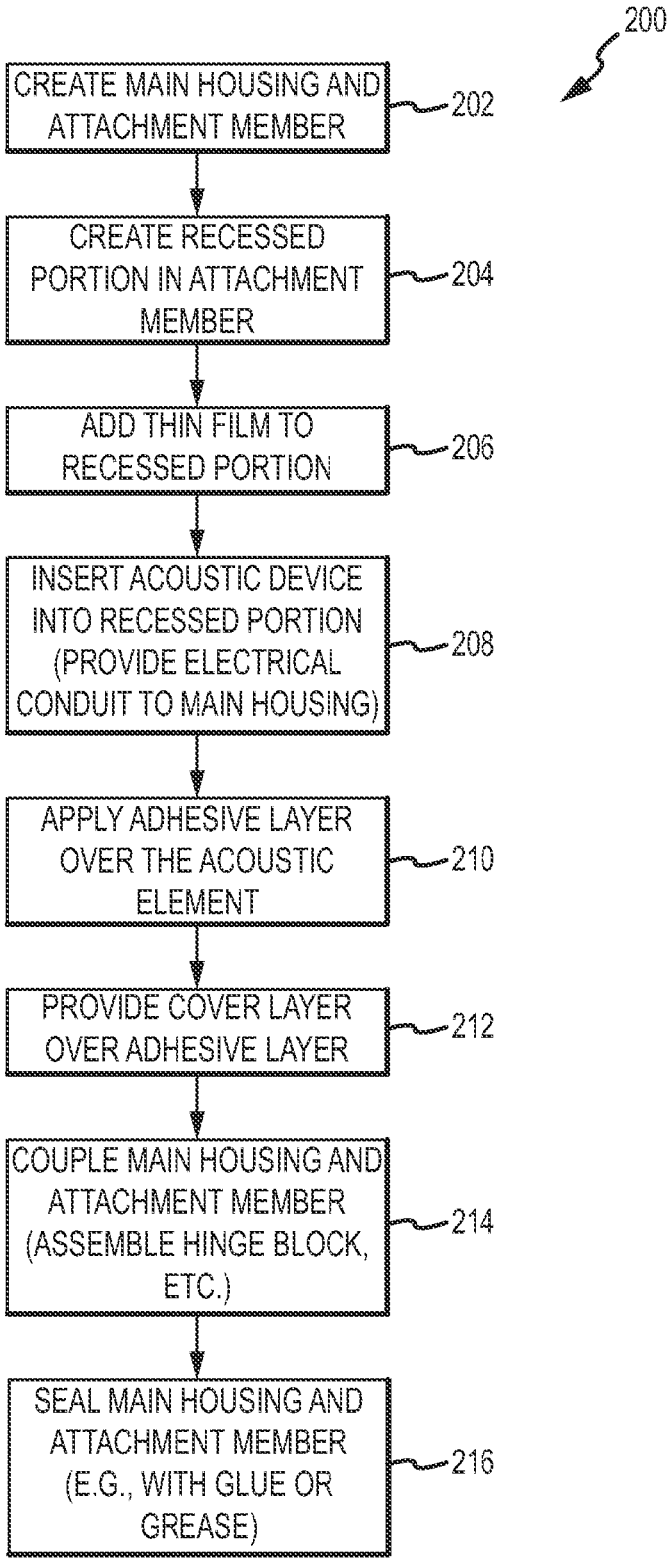
FIG. 10 is a flowchart of an example method of manufacturing the electronic device of FIG. 1.

FIG. 10 illustrates an example method of manufacturing 200 the electronic device 100. The method 200 may begin by creating the attachment member 102 and the housing 104 (Block 202). Any suitable process may be implemented to create the housing 104 and the attachment member 102, including casting (e.g., die casting), milling (e.g., computer numerical control (CNC) milling), extrusion or other suitable processes. In some embodiments, more than one process may be employed.

The attachment member 102 may then be processed to position the acoustical device within the attachment member (Block 204). The recessed portion may include features configured to help align the acoustical device and/or support the acoustical device. In some embodiments, additional processing of the attachment member 102 may be performed. Such additional processing may include customizing the volume that is to be defined by the attachment member and the acoustical device, such as dimpling the surface. Additionally, in some embodiments, a thin film in provided on the surface of the attachment member (Block 206).

The acoustical member is installed into the attachment member (Block 208). In some embodiments, a conduit may be thread through an aperture in the attachment member and the main housing to provide for communicative coupling between the components of the main housing and the acoustical device. An adhesive layer is provided over the acoustical element to secure the acoustical device within the recessed portion of the attachment member (Block 210). A cover layer is then installed over the adhesive (Block 212), which is also secured by the adhesive layer.

The method also includes coupling the attachment member to the main housing (Block 214). Coupling the attachment member and the main housing may include assembling a hinge block and providing a spring to hold the attachment member in a closed position relative to the main housing. Additionally, the method may include sealing the attachment member and main housing (Block 216). The sealing may be achieved by applying a grease or glue to apertures of the main housing and attachment member to prevent intrusion of water, dust and other contaminants.

Although various specific embodiments have been described above, it will be apparent to those having skill in the art that alternative arrangements and configurations not specifically shown or described herein may be achieved without departing from the spirit and scope of the present disclosure. As such, the embodiments described herein are intended as examples and not as limitations. In particular, in some embodiments, the main housing may hold a watch or pulse monitor and the attachment member may be a band, for example.

The invention claimed is:

1. An electronic device comprising:

a main housing encapsulating operative circuitry for the device;

an attachment member moveably coupled to the main housing with a spring loaded hinge to maintain the attachment member in a closed position relative to the main housing; and an acoustical device positioned within the attachment member, the acoustical device communicatively coupled to the operative circuitry in the main housing, wherein the attachment member comprises a recessed portion for positioning the acoustical device within the attachment member;

wherein an adhesive layer is positioned between the piezoelectric speaker and the attachment member and wherein a second adhesive layer is positioned over the piezoelectric speaker and a cover layer is positioned over the second adhesive layer, the second adhesive layer securing the cover layer to the piezoelectric speaker.

2. The device of claim 1 wherein the acoustical device is communicatively coupled to the operative circuitry with a coaxial conduit routed through a hinge block.

3. The device of claim 1, wherein the acoustical device is communicatively coupled to the operative circuitry via a flex microstrip.

4. The device of claim 1 wherein the acoustical device comprises a piezoelectric speaker.

5. The device of claim 4 wherein the recessed portion includes one or more guides to aid in positioning the piezoelectric speaker within the attachment member.

6. An electronic device comprising:

a main housing encapsulating operative circuitry for the device;

an attachment member moveably coupled to the main housing with a spring loaded hinge to maintain the attachment member in a closed position relative to the main housing;

an acoustical device positioned within the attachment member, the acoustical device communicatively coupled to the operative circuitry in the main housing, wherein the attachment member comprises a recessed portion for positioning the acoustical device within the attachment member; and at least one spring plate positioned on one of a surface of a hinge block or the attachment member where a spring member makes contact.

7. The device of claim 1 wherein a surface of the attachment member located over the acoustical device is substantially flat.

8. The device of claim 6, wherein the acoustical device is communicatively coupled to the operative circuitry with a coaxial conduit routed through the hinge block.

9. The device of claim 6, wherein the acoustical device is communicatively coupled to the operative circuitry via a flex microstrip.

10. The device of claim 6, wherein the acoustical device comprises a piezoelectric speaker.

11. The device of claim 10, wherein the recessed portion includes one or more guides to aid in positioning the piezoelectric speaker within the attachment member.

12. The device of claim 10, wherein an adhesive layer is positioned between the piezoelectric speaker and the attachment member.

13. The device of claim 6, wherein a surface of the attachment member located over the acoustical device is substantially flat.

* * * * *